United States Patent [19]

Ishii

[11] 4,366,472

[45] Dec. 28, 1982

[54] MOTOR ACTUATED BELL ASSEMBLY

[75] Inventor: Tadashi Ishii, Kunitachi, Japan

[73] Assignee: Kobishi Electric Co., Ltd., Tokyo, Japan

[21] Appl. No.: 206,026

[22] Filed: Nov. 12, 1980

[51] Int. Cl.[3] ..... G08B 3/10; G10K 1/26

[52] U.S. Cl. ..... 340/392; 340/393; 340/396; 340/402

[58] Field of Search ..... 340/392, 387, 388, 389, 340/390, 391, 393–404, 546; 116/152–166; 179/100 D

[56] References Cited

U.S. PATENT DOCUMENTS 483,309 9/1892 Raymond ..... 340/402
2,014,442 9/1935 Miller ..... 340/393
2,855,583 10/1958 Bonanno ..... 340/400 X

FOREIGN PATENT DOCUMENTS 849463 9/1960 United Kingdom ..... 179/100 D

*Primary Examiner*—John W. Caldwell, Sr.
*Assistant Examiner*—Daniel Myer
*Attorney, Agent, or Firm*—Darby & Darby

[57] ABSTRACT

A motor actuated bell assembly comprises a housing box having a body with an open top and a lid for closing the open top. The motor actuated bell includes a base having an integral support portion on which a gong is mouted. The base is fastened to the box body adjacent to the open top thereof with the motor actuated bell accommodated within the box body.

7 Claims, 5 Drawing Figures

MOTOR ACTUATED BELL ASSEMBLY

BACKGROUND OF THE INVENTION

1. Field of the Invention

This invention relates to motor actuated bell assemblies.

2. Prior Art

A conventional motor actuated bell assembly under consideration comprises a housing usually in the form of a box, and a motor actuated bell accommodated within the housing. The motor actuated bell generally comprises a base, a gong mounted on the base, and a motor actuated bell mechanism mounted on the base. The motor actuated bell mechanism includes an electric motor having a drive shaft, and a hammer operatively connected to the drive shaft of the motor for striking against the gong. The gong is connected to the base by a connecting means such as a C-shaped connective member. The base is secured to a mounting plate which in turn is secured to the housing to provide the motor actuated bell assembly. Such a conventional motor actuated bell assembly has been found somewhat complicated in construction and assemblage since the separate mounting plate is employed to mount the motor actuated bell within the housing. In addition, this naturally has increased the material cost.

SUMMARY OF THE INVENTION

It is therefore an object of this invention to provide a motor actuated bell assembly which is simple in construction and assemblage.

According to the present invention, there is provided a motor actuated bell assembly comprising: a housing box having a body with an open top and a lid for closing the open top; and a motor actuated bell including a base having an integral support portion projecting therefrom, a motor actuated bell mechanism mounted on that surface of the base on which the support portion is formed, and a gong mounted on the support portion; the motor actuated bell being mounted within the housing box, with the base being fastened to the box body adjacent to the open top thereof and with the motor actuated bell accommodated within the box body.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS

Figure 1:
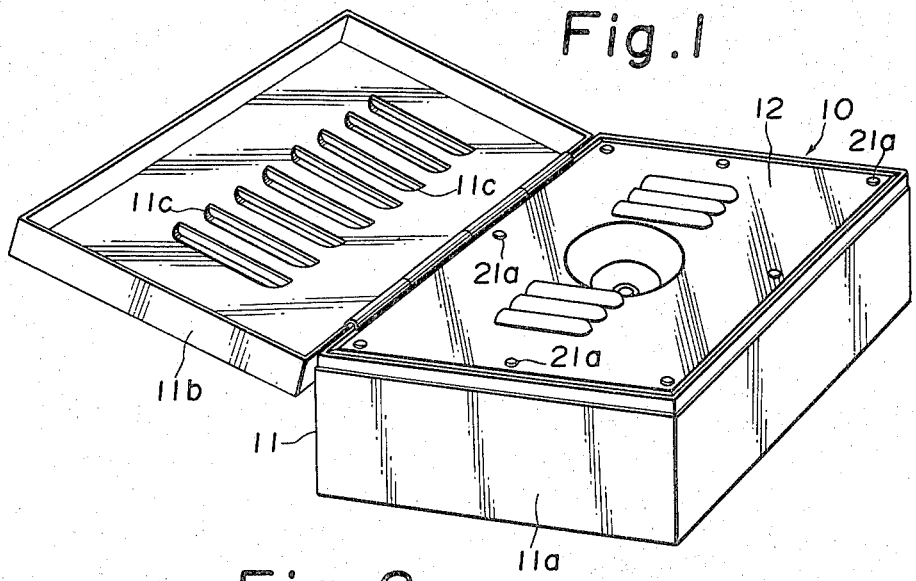
FIG. 1 is a perspective view of a motor actuated bell assembly constructed in accordance with the present invention.
Figure 2:
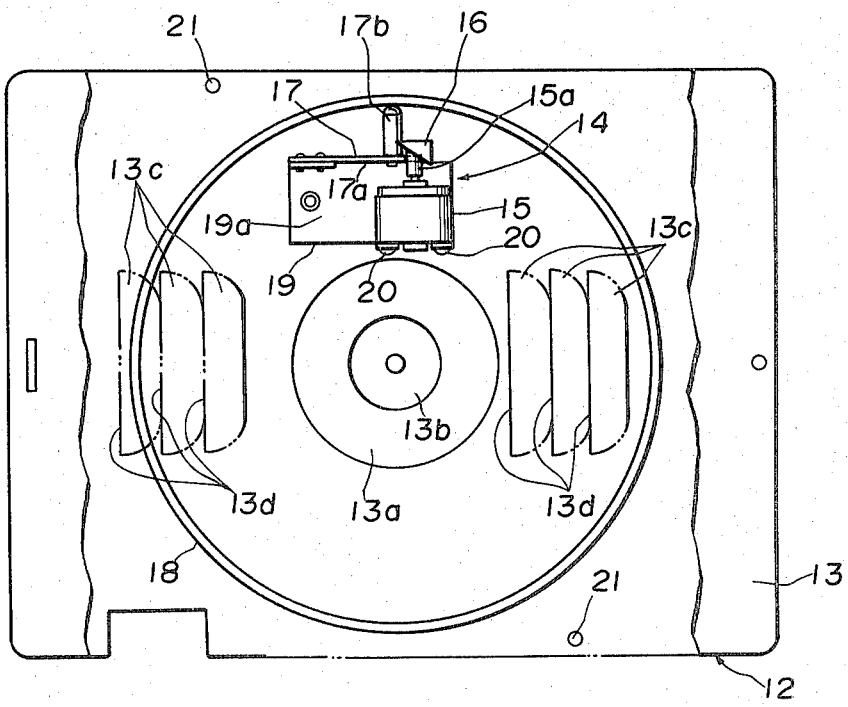
FIG. 2 is a plan view of a motor actuated bell.
Figure 3:
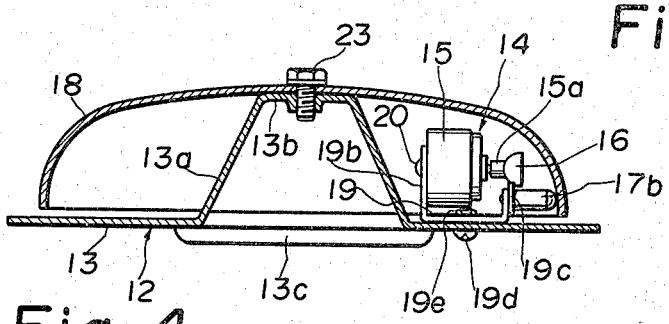
FIG. 3 is a cross-sectional view of the motor actuated bell.

FIG. 1 shows a motor actuated bell assembly 10 constructed in accordance with the present invention. The assembly 10 comprises a housing 11 in the form of a box and a motor actuated bell 12. As shown in FIGS. 2 and 3, the motor actuated bell 12 comprises a rectangular base 13 and a bell mechanism 14 mounted on the base. The bell mechanism includes an electric motor 15 having a drive shaft 15*a*, a cam 16 fixedly mounted on the drive shaft 15*a* for rotation therewith, and a hammer means 17 on which the cam 16 acts to move the hammer into striking contact with a gong 18 to produce bell sound. The hammer means 17 includes a leaf spring 17*a* and a hammer element 17*b* attached to one end of the leaf spring 17*a*. The motor 15 and the hammer means 17 are mounted on a support member 19, the support member having a rectangular planar base portion 19*a* and a pair of arms 19*b*, 19*c* extending right-angularly from the base portion 19*a* at its lateral edges, respectively. The support member 19 is secured to the base 13 by bolts 19*d* and nuts 19*e*. The motor 15 is secured to the arm 19*b* by screws 20, and the leaf spring 17*a* is secured to the arm 19*c* at its one end remote from the hammer element 17*b*.

While the motor actuated bell mechanism 14 of the type described is used in this embodiment, any other type of bell mechanism may be employed.

The base 13 is made of a thin metal sheet and has a central gong support portion 13*a* in the form of a hollow projection of a truncated cone-shape, the projection being formed by drawing. As best shown in FIG. 3, the motor actuated bell mechanism 14 is mounted on the surface of the base 13 on which the projection 13*a* is formed. The inner central portion of the cup-shaped gong 18 is mated with and secured to the top wall 13*b* of the truncated cone-shaped projection 13*a* by a bolt 23.

A plurality of indented formations 13*c* are formed on the base 13, the indented formations being drawn out of the plane of the base 13 away from the projection 13. As best shown in FIG. 2, each indented formation 13*c* is provided at the area adjacent to a slit 13*d*. In the illustrated embodiment, the indented formations 13*c* are disposed along the axis of the base 13, and three indented formations 13*c* are provided on each side of the projection 13*a*. The base 13 has screw holes 21 formed through its peripheral margin.

The housing box 11 is made of metal and has a body 11*a* with an open top and a closed bottom and a lid 11*b* hinged to the body for closing the open top. A plurality of indented formations 11*c* are also formed on the lid 11*b*, as described above for the base 13. The body 11*a* is so sized that the base 13 is fitted in the body. The housing body 11*a* has tabs (not shown) adjacent to its peripheral edge defining the open top of the box body, the tabs being disposed in registry with the respective screw holes 21 when the base 13 is installed in place in the housing box 11.

For installing the motor actuated bell 12 in the housing box 11 to provide the motor actuated bell assembly 10, the base 13 is fitted in the housing body 11*a* upside down, that is to say, with the motor actuated bell 12 and the projection 13*a* being accommodated with the box body 11*a*. In this condition, the screw holes 21 are disposed in alignment with the above-mentioned tabs of the box body 11*a*. The base 13 is fastened to the box body 11*a* by screws 21*a* passing through the respective aligned screw holes 21 and tabs. Then, the lid 11*b* is closed and fastened to the body 11*a* by a suitable fastening means (not shown).

With this construction, the motor actuated bell assembly 10 obviates the need for a mounting plate for mounting the motor actuated bell 12 within the housing box 11. More specifically, the base 13 is of such a construction that it is directly mounted onto the housing box 11.

Figure 4:
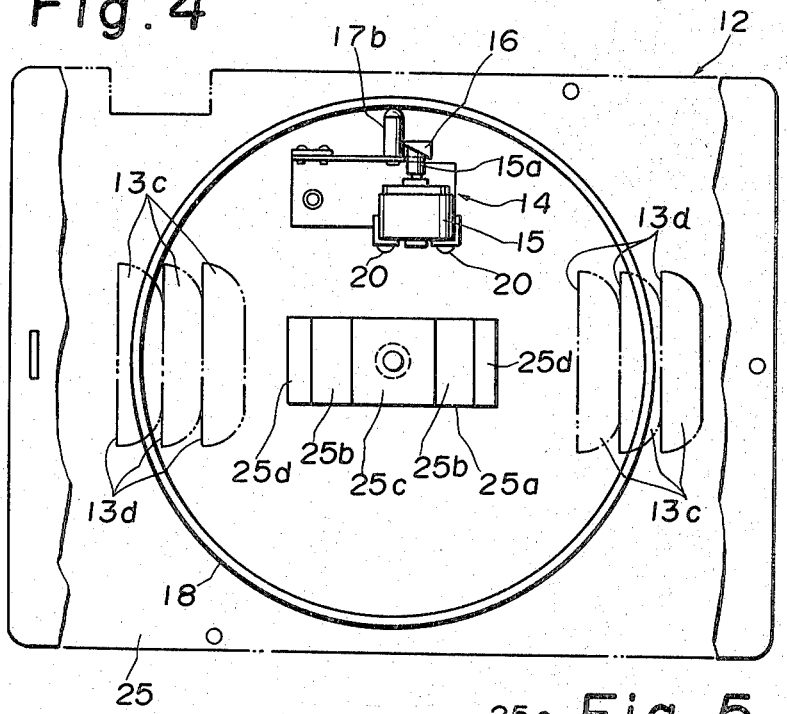
FIG. 4 is a view similar to FIG. 2 but showing a modified base.
Figure 5:
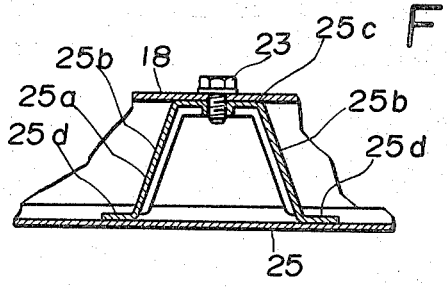
FIG. 5 is a fragmentary, cross-sectional view of the motor actuated bell of FIG. 4.

According to a modified form of the invention shown in FIGS. 4 and 5, a base 25 has a central gong support portion 25*a* of a trapezoidal cross-section. The support portion 25*a* comprises an elongated rectangular metal plate which is pressed into a trapezoidal cross-section having a pair of arms 25*b* and a top wall 25*c* interconnecting the arms at their one ends, the support portion having a pair of flanges 25*d*. As best shown in FIG. 5, the inner central portion of the cup-shaped gong 18 is mated with and secured to the top wall 25*c* of the support portion 25*a* by a bolt 23. The pair of flanges 25*d* is fixedly secured to the base 25 by spot welding. The support portion 25*a* is disposed at the center of the base 25. A plurality of indented formations 13*c* are formed on the base 25, as described above for the base 13. The base 25 is fitted in and secured to the box body 11*a* in the manner as described above for the base 13.

By virtue of the provision of the base 13, 25, the motor actuated bell 12 can be mounted on the housing box 11 with utmost ease.

While the motor actuated bell assemblies according to the invention have been specifically shown and described herein, the invention itself is not to be restricted by the exact showing of the drawings or the description thereof.

What is claimed is:

1. A motor actuated bell assembly comprising:

(a) a housing box having a body with an open top and a lid for closing said open top; and (b) a motor actuated bell, said bell including a base formed with an integral support portion projecting from one surface thereof, a motor driven actuating mechanism mounted on said surface, and a cup-shaped gong mounted on the distal end of said support portion, said motor driven actuating mechanism including hammer means and being accommodated within said gong so that said hammer means is adapted to be brought into striking contact with the inner wall of said gong;

(c) said motor actuated bell being mounted within said housing box, said base being fastened to said box body adjacent to said open top thereof and said motor actuated bell being accommodated within said box body.

2. A motor actuated bell assembly according to claim 1, in which a plurality of slits are formed in said base, and an indented formation is provided at an area of said base adjacent to each of said slits.

3. A motor actuated bell assembly according to claim 1, in which said support portion is disposed at the center of said base.

4. A motor actuated bell assembly according to claim 1, in which said support portion is a hollow projection extending integrally from said base, said projection having a top wall on which said gong is mounted.

5. A motor actuated bell assembly according to claim 4, in which said hollow projection is in the shape of a truncated cone.

6. A motor actuated bell assembly according to claim 1, in which said support portion comprises a plate member of generally U-shaped cross-section having a pair of arms and a top wall interconnecting said arms at their distal ends, said gong being mounted on said top wall.

7. A motor actuated bell assembly according to claim 6, in which said plate member has a trapezoidal cross-section.

* * * * *